US005754156A

United States Patent [19]

Erhart et al.

[11] Patent Number: 5,754,156

[45] Date of Patent: May 19, 1998

[54] LCD DRIVER IC WITH PIXEL INVERSION OPERATION

[75] Inventors: Richard Alexander Erhart, Chandler; James Richard Kozicek, Mesa, both of Ariz.

[73] Assignee: Vivid Semiconductor, Inc., Chandler, Ariz.

[21] Appl. No.: 715,788

[22] Filed: Sep. 19, 1996

[51] Int. Cl.[6] ..... G09G 3/36

[52] U.S. Cl. ..... 345/98; 345/89; 345/211

[58] Field of Search ..... 345/58, 89, 98, 345/99, 204, 211; 341/144

[56] References Cited

U.S. PATENT DOCUMENTS

| | | | |
|---|---|---|---|
| 4,714,921 | 12/1987 | Kanno et al. | 340/784 |
| 4,955,696 | 9/1990 | Taniguchi et al. | 350/332 |
| 5,130,703 | 7/1992 | Fairbanks et al. | 340/784 |
| 5,168,270 | 12/1992 | Masumori et al. | 340/784 |
| 5,170,155 | 12/1992 | Plus et al. | 340/784 |
| 5,170,158 | 12/1992 | Shinya | 340/800 |
| 5,192,945 | 3/1993 | Kusada | 340/784 |
| 5,198,747 | 3/1993 | Haight | 323/303 |
| 5,262,720 | 11/1993 | Senn et al. | 324/158 |
| 5,283,565 | 2/1994 | Suzuki et al. | 345/98 |
| 5,510,748 | 4/1996 | Erhart et al. | 327/530 |
| 5,528,256 | 6/1996 | Erhart et al. | 345/96 |

OTHER PUBLICATIONS

"Capactively Coupled TFT–LCD Driving Method", by E. Takeda, Y. Nan–no, Y. Mino, A. Otsuka, S. Ishihara, S. Nagata, *Proc. SID*, 1990, pp. 87–94.

"An 8.4–in. TFT–LCD System For A Note–Size Computer Using 3–Bit Digital Data Drivers", by H. Okada, M. Tanaka, M. Okano, S. Ushira, H. Fukuoka, Y. Kanatani, M. Hijikigawa, *Japan Display*, 1992, pp. 475–478.

"A 15–in. Diagonal Full–Color High Resolution TFT–LCD", by H. Maeda, K. Fujii, N. Yamagishi, H. Fujita, S. Ishihara, K. Adachi, *SID 92 Digest*, pp. 47–50.

*Primary Examiner*—Jeffery Brier

*Attorney, Agent, or Firm*—Cahill, Sutton & Thomas, P.L.C.

[57] ABSTRACT

A column-driver integrated circuit, and related method, for driving the columns of LCD displays uses paired digital-to-analog converters to provide analog signals in an upper voltage range and in a lower voltage range. During a first drive cycle, first and second digital data words are provided to the first and second digital-to-analog converters; the first and second digital data words represent the magnitudes, within the upper voltage range and lower voltage range, respectively, of the analog signals to be driven onto first and second columns of the LCD display. The analog signal generated by the first D/A converter is selected, as by a multiplexer, onto the first column of the display, and the analog signal generated by the second D/A converter is selected onto the second column of the display. During a second subsequent drive cycle, first and second digital data words are again provided to the first and second D/A converters, but now the first and second digital data word represent the magnitudes, within the upper voltage range and lower voltage range, respectively, of the analog signals to be driven onto the second and first columns, respectively, of the LCD display. The analog signal generated by the first D/A converter during the second drive cycle is selected onto the second column of the display, and the analog signal generated by the second D/A converter is selected onto the first column of the display.

8 Claims, 2 Drawing Sheets

LCD DRIVER IC WITH PIXEL INVERSION OPERATION

BACKGROUND OF THE INVENTION

1. Field of the Invention

The present invention relates generally to integrated circuits used to drive liquid crystal displays (LCDs), and more particularly to an integrated circuit for economically driving an LCD display using column inversion and/or pixel inversion techniques.

2. Description of the Related Art

The trend toward larger, higher resolution, higher color displays in notebook computers is forcing display manufacturers to use new electrical drive methods within the integrated circuits which drive the displays. Thin Film Transistor (TFT) displays for notebook computers have quickly migrated from eight inch, 256 color, low-resolution displays to 12.1 inch, 262,000 color, high-resolution displays. In addition, the emerging cathode-ray-tube (CRT) replacement market is promising 16-inch, 16.7 million color, very high resolution LCD displays in the near future. Current methods used to drive these displays are subject to excessive power dissipation and reduced image quality at resolutions above "Super VGA".

LCD display panel manufacturers are returning to Direct Drive as the answer to these problems. Direct Drive was originally used several years ago by many major LCD manufacturers; however, Direct Drive was later abandoned due to cost concerns. Direct Drive requires higher-voltage driver circuits (i.e., driver circuits which generate a larger range of analog output voltages) which, historically, have been much more expensive to produce; one reason for this greater expense is that higher voltage ranges typically require larger device geometries, and more chip real estate. Yet, Direct Drive offers dramatic improvements in image quality and power dissipation, as compared with current methods used to drive complex displays.

The "complexity" of a display is a combination of the display size, display resolution, and number of colors. As display complexity increases, power dissipation associated with such display typically increases. In addition, as display complexity increases, the quality of the image displayed typically tends to decrease. The problems associated with power dissipation and image quality are leading display manufacturers back to Direct Drive techniques for driving Flat Panel LCD Displays.

A typical TFT display is made up of both rows and columns. The intersection of each row and column represents the location of a TFT color cell, called a pixel. The circuitry for driving such display includes integrated circuits known as row drivers which control each row of a display, and simply turn each row on or off, one at a time, to allow access to the pixels in that row. The circuitry used to drive the LCD display also includes integrated circuits known as column drivers which are responsible for updating the shade of color in the pixels of the selected row. The present invention is directed to such column driver integrated circuits.

To produce color shades, the pixels in an LCD display require an alternating voltage, which alternates between "positive" and "negative" polarities. In addition, the magnitude of such voltage within the "positive" or "negative" range, will determine the shade of the color, such as ranging from white to black, or from light blue to dark blue.

The aforementioned term "Direct Drive" refers to the ability of the column driver chips to directly provide the alternating voltage and the variable magnitudes of such voltage to each pixel cell. Other driving methods rely upon additional integrated circuits in the system to create alternating polarities. For example, it is presently typical to apply an alternating voltage to the backplane of an LCD display while applying voltages of opposite polarity to each of the columns within the LCD display. The column driver circuits in such common backplane systems supply only the variable voltage magnitude, while additional circuitry must drive the common backplane to alternate the voltage across each pixel; this technique is called V-com Modulation because of the additional integrated circuits used to modulate the positive and negative voltages on the common plate, or backplane of the display. Thus, Direct Drive is capable of forcing both polarity and magnitude on the pixels by driving the columns only, while V-com Modulation requires an additional polarity driver to drive the large common plate of the display. For the reasons explained below, driving the large common plate using V-com Modulation increases power dissipation and reduces the image quality of the display.

The various techniques used by display manufacturers to alternate the voltages applied to the pixels are referred to as inversion methods. In a rather straightforward technique called frame inversion, the entire display (i.e., all of the pixels in the display) is updated with various positive polarity voltages during a first frame, by negative polarity voltages in a second frame, by positive polarity voltages in a third frame, and so forth. In other words, all of the pixels in the LCD array are positive concurrently during one frame, and all of the pixels in the LCD array are negative concurrently in the next frame. Incidentally, it should be understood that the term "negative voltage" is a relative term and refers to the voltage difference between a pixel cell and the common terminal of the display. A pixel voltage can be considered "negative" if below +5 volts, for example, even though such voltage is above ground potential.

In a second technique known as row inversion, the polarity of the voltage applied to the pixels in successive, adjacent rows of the display is alternated; during a first frame period, the voltages applied to the first row of pixels are positive, the voltages applied to the second row of pixels are negative, the voltages applied to the third row of pixels are positive, etc. During a next succeeding frame period, this relationship is reversed, i.e., the voltages applied to the first row of pixels are negative, the voltages applied to the second row of pixels are positive, the voltages applied to the third row of pixels are negative, etc.

A third technique that has also been used is known as column inversion. As the name implies, during a first frame period, all of the pixels within a first column are at positive voltages, all of the pixels in the second column are at negative voltages, all of the pixels in the third column are at positive voltages, etc. During a next succeeding frame period, the relationship is reversed, i.e., all of the pixel voltages in the first column are negative, all of the pixel voltages in the second column are positive, all of the pixel voltages in the third column are negative, and so forth.

Finally, the method known as pixel inversion, causes each pixel located at a particular row and column to have a voltage that is opposite in polarity to the voltage of any adjacent pixel during any frame period. For example, during a first frame period, the pixel located at row 1, column 1, is positive; the pixel located at row 1, column 2, is negative; the pixel located at row 2, column 1, is negative; and the pixel located at row 2, column 2, is positive. During the next succeeding frame period, the polarities are reversed, such that the pixel voltage at row 1, column 1, is negative; the pixel voltage at row 1, column 2, is positive; the pixel voltage at row 2, column 1, is positive and the pixel voltage at row 2, column 2, is negative.

The above-described column inversion and pixel inversion driving methods can provide significant improvements in power dissipation and image quality over the other inversion methods. The Direct Drive technique for driving pixel voltages can provide any of the four inversion methods described above. In contrast, V-com Modulation can provide only frame inversion or row inversion, since positive and negative voltages are provided via the common plate or backplane. The use of such a common plate to provide the polarity of the pixel voltages requires that, as each row is updated, the polarity of the pixels in that row must be identical to each other. This necessarily excludes the column inversion and pixel inversion methods.

The problem of image quality has been mentioned above. One component of image quality is known as "flicker". Since the human eye is very adept at noticing fluctuations or changes in a visual image, a display must be updated at a rather fast rate to prevent noticeable flicker. Flicker is even more noticeable when the fluctuation is over a larger area. Column inversion reduces flicker as compared with frame and row inversion; pixel inversion even further reduces the problem of flicker as compared with column inversion. Only the so-called Direct Drive method of applying pixel voltages can be used to achieve column inversion and pixel inversion.

Another aspect of image quality is the problem of "crosstalk"; crosstalk refers to errors caused by the presence of similar voltage polarities at neighboring pixels. Crosstalk errors can be canceled by ensuring that neighboring pixels use opposite polarities. Such crosstalk errors are minimized when pixel inversion is used; once again, pixel inversion requires that the Direct Drive method of driving pixel voltages be used.

The inversion method and drive method used to drive the LCD display also influence the amount of power dissipated. While frame inversion conserves power, frame inversion is also subject to flicker and high levels of crosstalk. Column inversion conserves power very well, eliminates flicker, but is still subject to low levels of crosstalk. Pixel inversion also reduces power dissipation (though not as well as column inversion); moreover, pixel inversion is not subject to either flicker or crosstalk, thereby producing the best image quality. Once again, column inversion and pixel inversion require the Direct Drive technique for applying pixel voltages. It should therefore be apparent that the combination of Direct Drive and pixel inversion for driving an LCD display is the best technique for dealing with the problems of power dissipation and poor image quality.

As mentioned above, LCD display manufacturers abandoned Direct Drive in the past as a result of its requirement for more-expensive, higher voltage column drivers. These higher voltage column driver integrated circuits typically required special manufacturing methods and were not readily available in significant volumes. In addition, for the relatively small low resolution displays of the past, V-com Modulation techniques were adequate.

LCD color display panels in wide use today typically require an alternating voltage having a magnitude of approximately ten volts in order to drive each pixel in the display. When V-com Modulation is used, the column driver integrated circuits need to produce output voltages that range only between approximately zero and +5 volts; the remainder of the voltage difference applied across each pixel is created by varying the polarity of the common voltage applied to the backplane of the display. In contrast, the Direct Drive method of applying pixel voltages requires that the integrated circuit column drivers have outputs capable of driving through the full ten volt output swing (zero volts to +10 volts).

In the past, high voltage integrated circuit column drivers have commonly included a separate digital-to-analog converter for each output driver terminal of such integrated circuit. Moreover, if the full range of output voltages to be applied on each column included 256 different voltages, for example, then each of the separate digital-to-analog converters had to be capable of generating each of such 256 different full-range voltages. Since one such column driver integrated circuit may typically include as many as 384 output terminals, the number and complexity of the required digital-to-analog converter circuits is significant, and can quickly increase the overall complexity of such column driver integrated circuits. Greater complexity typically means lower yields and higher costs.

Accordingly, it is an object of the present invention to provide an improved integrated circuit column driver for driving the columns of an LCD display which is adapted to use the Direct Drive method of applying pixel voltages without requiring a separate full-voltage range digital-to-analog converter for each column output terminal.

Another object of the present invention is to provide such an improved integrated circuit column driver which directly drives each pixel voltage but which does not require that any single digital-to-analog converter circuit produce a full-range analog output voltage.

Still another object of the present invention is to provide such an improved integrated circuit column driver that is compatible with either of the above-described column inversion and pixel inversion driving methods in order to limit power dissipation and improve the image quality of the display by reducing flicker and crosstalk.

A further object of the present invention is to provide such a column driver integrated circuit of reduced complexity for achieving higher yields and lower costs.

These and other objects of the present invention will become more apparent to those skilled in the art as the description of the present invention proceeds.

SUMMARY OF THE INVENTION

Briefly described, and in accordance with the preferred embodiment thereof, the present invention is a column-driver integrated circuit for generating analog output voltages to be applied to the columns of an LCD display, and wherein the analog output voltages fall within either an upper voltage range (corresponding to a first or positive polarity) or a lower voltage range (corresponding to a second or negative polarity). The column-driver integrated circuit includes a first digital-to-analog converter circuit having input terminals for receiving a first digital data word that corresponds to the magnitude of a voltage within the upper voltage range; this first digital-to-analog converter generates a corresponding first analog voltage signal. Similarly, the column-driver integrated circuit includes a second digital-to-analog converter circuit having input terminals for receiving a second digital data word that corresponds to the magnitude of a voltage within the lower voltage range; this second digital-to-analog converter generates a corresponding second analog voltage signal.

The integrated circuit includes at least first and second column output terminals to drive first and second columns, respectively, within an LCD display. Analog multiplexer circuitry is interposed between the first and second digital-to-analog converters and the first and second column output terminals for receiving the first and second analog voltage signals. During a first column driving cycle, the analog multiplexer circuitry provides the first analog voltage signal to the first column output terminal, and provides the second analog voltage signal to the second column output terminal; however, during a second column driving cycle, the analog multiplexer circuitry provides the first analog voltage signal to the second column output terminal, and provides the second analog voltage signal to the first column output terminal. In this manner, the first and second column output terminals share both the first and second digital-to-analog converters.

To coordinate such sharing of the first and second digital-to-analog converter circuits, a polarity control signal is provided having a first state during the first column driving cycle and having a second state during the second column driving cycle. The analog multiplexer circuitry receives the polarity control signal and responds thereto by providing the first analog voltage signal within the upper voltage range to the first column output terminal, and by providing the second analog voltage signal within the lower voltage range to the second column output terminal, when the polarity control signal is in its first state. In contrast, when the polarity control signal is in its second state, then the analog multiplexer circuitry provides the first analog voltage signal within the upper voltage range to the second column output terminal, and provides the second analog voltage signal within the lower voltage range to the first column output terminal.

The aforementioned analog multiplexer circuitry is preferably provided by first and second multiplexers associated with the first and second column output terminals, respectively. The first multiplexer receives the first and second analog voltage signals and transmits the first analog voltage signal to the first column output terminal when the polarity control signal is in its first state, while transmitting the second analog voltage signal to the first column output terminal when the polarity control signal is in its second state. Likewise, the second multiplexer receives the first and second analog voltage signals and transmits the second analog voltage signal to the second column output terminal when the polarity control signal is in its first state, while transmitting the first analog voltage signal to the second column output terminal when the polarity control signal is in its second state.

In the preferred embodiment of the present invention, first and second data latches are provided at the input terminals of the first and second digital-to-analog converters for temporarily storing current first and second digital data words during each column driving cycle and providing the temporarily stored current first and second digital data words to the input terminals of the first and second digital-to-analog converters, respectively. This allows the integrated circuit to fetch data that will be needed during the next succeeding column driving cycle without affecting the voltages provided to the column output terminals.

The sharing of the first and second digital-to-analog converters also requires that the input digital data to be processed by the first and second digital-to-analog converters be properly routed to the first and second digital-to-analog converters during different column driving cycles. Accordingly, the present invention preferably includes a digital input multiplexer having input terminals for receiving a first multi-bit digital signal representing the magnitude of the analog voltage to be provided at the first column output terminal and for receiving a second multi-bit digital signal representing the magnitude of the analog voltage to be provided at the second column output terminal. This digital input multiplexer also receives the polarity control signal and responds thereto by providing the first multi-bit digital signal to the first digital-to-analog converter circuit as the first digital data word thereof, while providing the second multi-bit digital signal to the second digital-to-analog converter circuit as the second digital data word thereof, when the polarity control signal is in its first state. In contrast, when the polarity control signal is in its second state, then the digital input multiplexer provides the first multi-bit digital signal to the second digital-to-analog converter circuit as the second digital data word thereof, while providing the second multi-bit digital signal to the first digital-to-analog converter circuit as the first digital data word thereof.

The present invention also provides a method of sharing digital-to-analog converters in a column-driver integrated circuit used to drive output voltages upon the columns of an LCD display, wherein the output voltages again fall within either an upper voltage range or a lower voltage range. The method of the present invention includes the step of providing first and second digital-to-analog converters for producing a first analog output voltage within the upper voltage range and a second analog output voltage within the lower voltage range, respectively. The method further includes the step of defining successive display drive cycles, including at least a first and second display drive cycle. During the first display drive cycle, a first digital data word is provided to the first digital-to-analog converter corresponding to a voltage within the upper voltage range to be driven onto a first column of the LCD display; at the same time, a second digital data word is provided to the second digital-to-analog converter circuit corresponding to a voltage within the lower voltage range to be driven onto a second column of the LCD display. During this first display drive cycle, the analog output voltage of the first digital-to-analog converter is selected to the first column of the LCD display, and the analog output voltage of the second digital-to-analog converter is selected to the second column of the LCD display.

During a second display drive cycle, the aforementioned method steps are reversed; namely, a first digital data word is provided to the first digital-to-analog converter corresponding to a voltage within the upper voltage range to be driven onto the second column of the LCD display, and a second digital data word is provided to the second digital-to-analog converter circuit corresponding to a voltage within the lower voltage range to be driven onto the first column of the LCD display. The analog output voltage of the second digital-to-analog converter is then selected to the first column of the LCD display, and the analog output voltage of the first digital-to-analog converter is selected to the second column of the LCD display.

DETAIL DESCRIPTION OF THE PREFERRED EMBODIMENT

Figure 1:
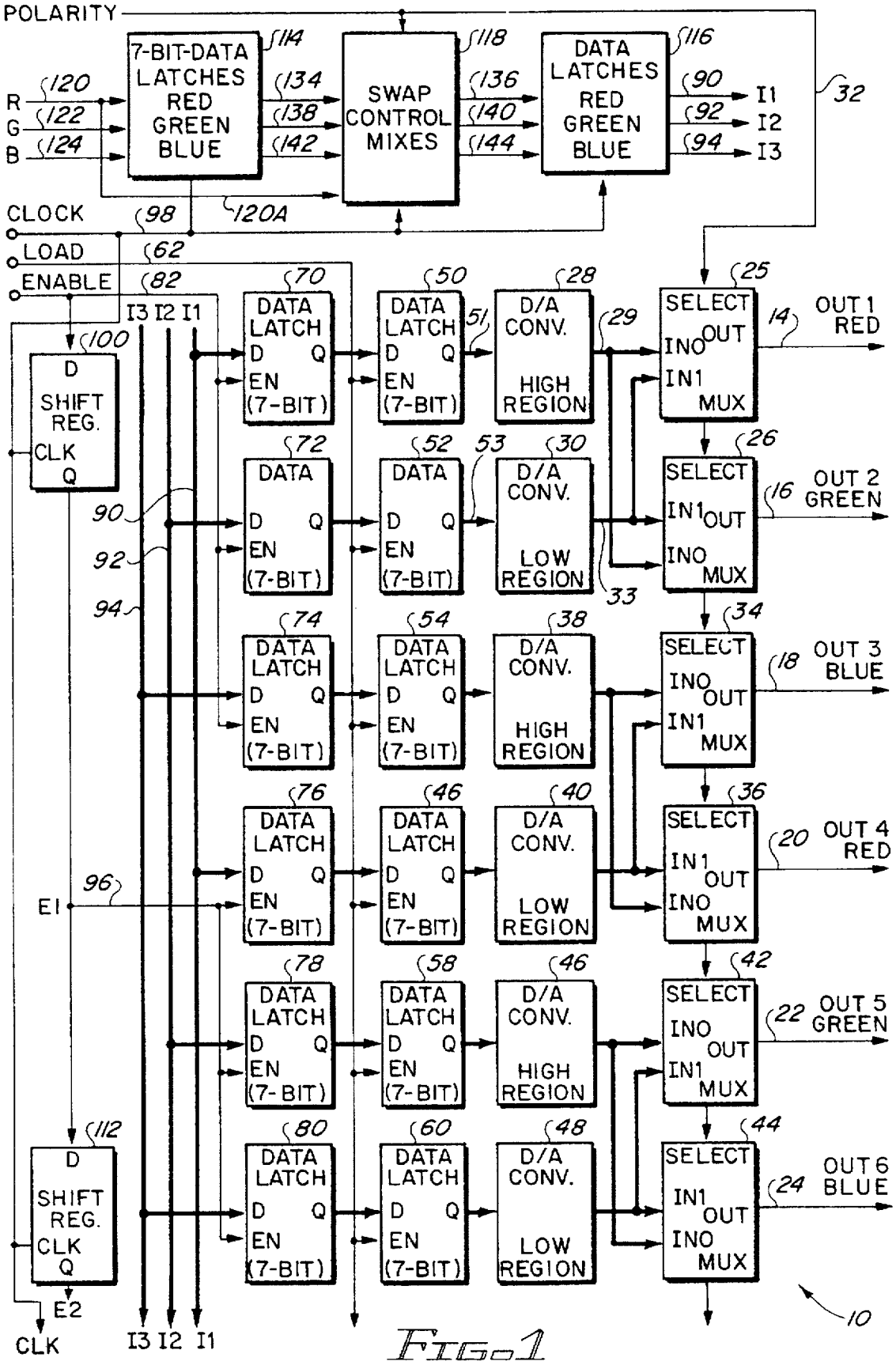
FIG. 1 is a block diagram of an integrated circuit column driver incorporating the present invention.

Within the preferred embodiment of the present invention illustrated in FIG. 1, integrated circuit 10 is a column driver circuit adapted to drive analog voltages onto the columns of a liquid crystal display (not shown) organized as a series of rows and columns. Integrated circuit 10 includes a large number of column output terminals (only the first six are shown in FIG. 1), each used to drive a predetermined analog output voltage onto a corresponding column for charging such voltage onto a pixel in a selected row of the LCD array. Such column output terminals include OUT 1 (identified by reference numeral 14), OUT 2 (16), OUT 3 (18), OUT 4 (20), OUT 5 (22), and OUT 6 (24). Column output terminal 14 (OUT 1) is coupled to column 1 of the LCD display, column output terminal 16 (OUT 2) is coupled to column 2 of the LCD display, etc., while column output terminal 24 (OUT 6) is coupled to column 6 of the LCD display.

In the preferred embodiment of the present invention, each discrete point on the LCD display includes a red pixel, a green pixel, and a blue pixel, each controlled by a separate column. Accordingly, OUT 1 is used to control a red pixel, OUT 2 is used to control a green pixel, and OUT 3 is used to control a blue pixel, all corresponding to roughly the same discrete point on the display. Likewise, OUT 4 is used to control a red pixel, OUT 5 is used to control a green pixel, and OUT 6 is used to control a blue pixel, all corresponding to roughly the same second discrete point on the display.

Integrated circuit 10 is adapted to use the Direct Drive technique described above for applying analog voltages to the columns, and hence the pixels, of the LCD display. In the preferred embodiment, these analog voltages fall within one of two voltage ranges, corresponding to a lower voltage range (e.g., 0 to +5 volts) and a higher voltage range (e.g., +5 volts to +10 volts). In some cases, analog voltages within the upper voltage range are regarded as being of "positive" polarity, while analog voltages within the lower voltage range are regarded as being of "negative" polarity. If it is assumed, by way of example, that each pixel voltage can be represented by an eight-bit digital word, then the most-significant bit might be used to represent the "polarity" of the analog voltage (i.e., whether it is in the upper voltage range or lower voltage range), while the other seven bits represent the magnitude of the analog voltage within such upper or lower voltage range.

Within FIG. 1, each of column output terminals 14–24 is capable of providing a full range output signal. For example, output terminal 14 (OUT 1) can provide a voltage in the range between +5 volts and +10 volts when the polarity of column 1 of the LCD display is positive; output terminal 14 (OUT 1) can also provide a voltage within the range of zero volts to +5 volts when the polarity of the voltage on column 1 of the LCD display is negative. Likewise, each of column output terminals 16, 18, 20, 22 and 24 may provide a full range voltage in a similar manner.

Column output terminal 14 is coupled to the output of a first multiplexer 25; likewise, column output terminal 16 is coupled to the output of a second multiplexer 26. First and second multiplexers 25 and 26 share the same input signals. Thus, both first multiplexer 25 and second multiplexer 26 receive, as an input signal, a first analog voltage generated by high-level digital-to-analog converter circuit 28 at a first analog voltage output terminal 29 thereof. Similarly, both first multiplexer 25 and second multiplexer 26 receive a second analog voltage generated at the second analog voltage output terminal 33 of low-level digital-to-analog converter circuit 30.

Figure 2:
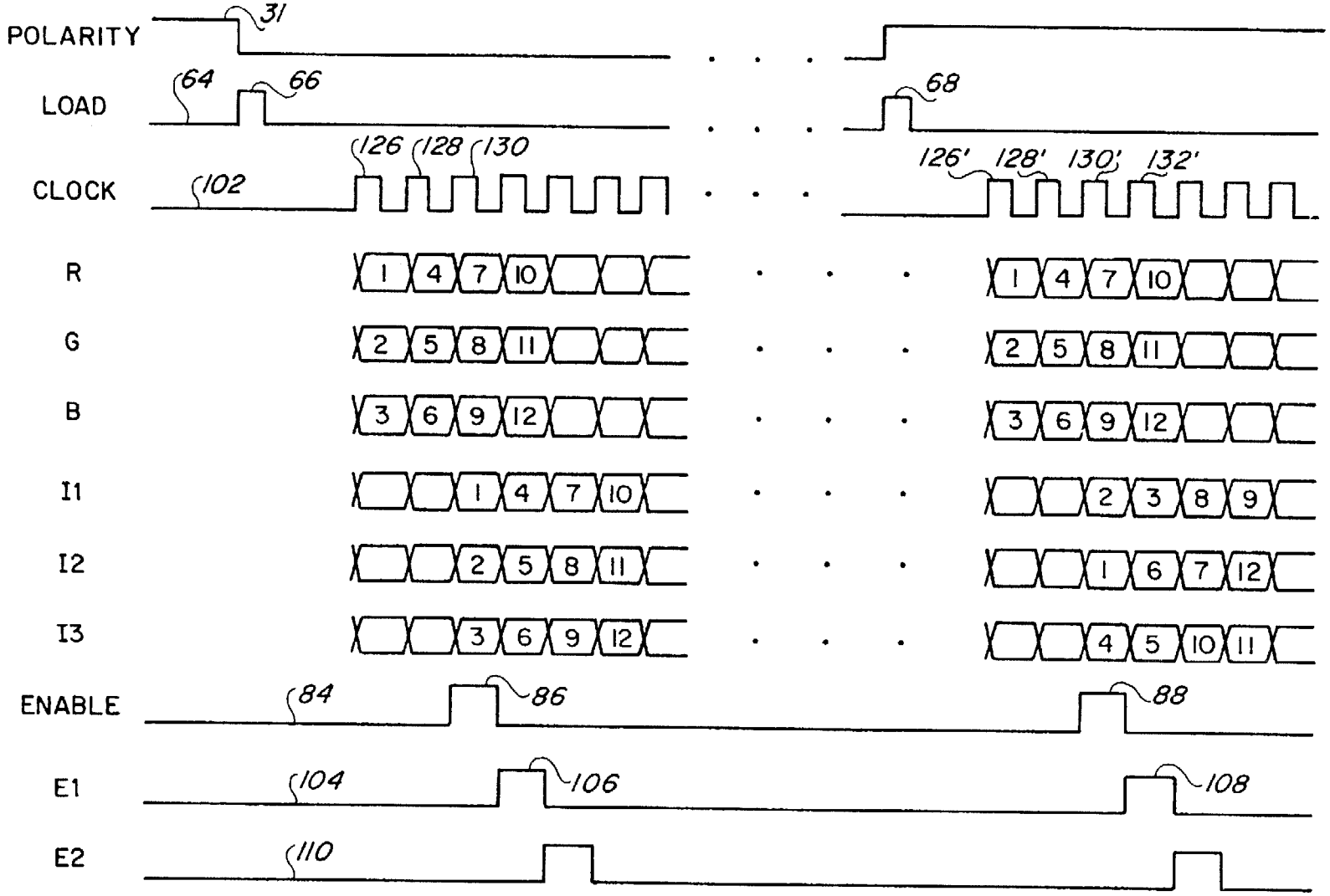
FIG. 2 is a waveform timing diagram explaining the operation of the components shown in FIG. 1.

Both first multiplexer 25 and second multiplexer 26 also receive a polarity control signal 31 (see FIG. 2) from polarity control conductor 32. The polarity control signal is a binary logic signal having first and second states, i.e., logic high and logic low. When the column inversion technique is used to drive the LCD display, the polarity control signal can remain at the same state as the row drivers select successive rows within the LCD array during each pixel frame period; the polarity control signal need only switch state once for each pixel frame cycle. On the other hand, when the pixel inversion technique is used, as depicted in FIG. 2, then the polarity control signal is switched each time a new row in the LCD array is selected.

When polarity control signal 31 is low, first multiplexer 25 passes the first analog voltage received from high-level D/A converter 28 to output terminal 14. Also, when polarity control signal 31 is low, second multiplexer 26 passes the second voltage: analog voltage received from low-level D/A converter 30 to output terminal 16. Thus, during this first row drive period, column 1 of the LCD display is provided with a positive polarity signal within the high-level voltage range of +5 volts to +10 volts, while the adjacent column 2 is provided with a negative polarity signal having a voltage within the range of zero volts to +5 volts.

Output terminal 18 is coupled to the output of a third multiplexer 34, while output terminal 20 is coupled to the output of a fourth multiplexer 36. As was true for output terminals 14 and 16, output terminals 18 and 20 can share the analog output signals generated by high-level D/A converter 38 and low-level D/A converter 40. Third multiplexer 34 also receives polarity control signal 31 and operates in the same manner as first multiplexer 25 for passing the high-level analog voltage developed by high-level D/A converter 38 to output terminal 18 when polarity control signal 31 is at a low level. Likewise, fourth multiplexer 36 operates similarly to second multiplexer 26, passing the low-level analog voltage generated by low-level D/A converter 40 to output terminal 20 when polarity control signal 31 is low. Those skilled in the art will appreciate that every output signal is of the opposite polarity as its neighboring output terminals. For example, when polarity control signal 31 is at a low level, output terminal 16, which drives the second column of the LCD display, is within the low voltage level range, while neighboring output terminals 14 and 18 (which drive the first and third columns of the LCD display), are both within the high voltage level range. This manner of operation is consistent with the column driving techniques of column inversion and pixel inversion discussed above.

In a similar manner, the voltages provided to column output terminals 22 and 24 are selected by multiplexers 42 and 44, respectively, which share the high-level and low-level analog signals generated by high-level D/A converter 46 and low-level D/A converter 48.

During a next succeeding row drive period, the polarity applied to each pixel within the selected row of the display is to be reversed. Accordingly, during this second row drive period, polarity control signal 31 switches to a high level. First multiplexer 25 now selects the second analog voltage generated at output 33 of low-level D/A converter 30 and passes such low level voltage to output terminal 14 for being driven onto column 1 of the LCD display. Second multiplexer 26 now selects the high-level analog voltage generated at output 29 of high-level D/A converter 28, and passes such voltage to output terminal 16 for being driven onto the second column of LCD display. In a similar fashion, multiplexers 34 and 42 select the low-level analog voltages generated by D/A converters 40 and 48 onto output terminals 18 and 22, respectively, while multiplexers 36 and 44 select the high-level analog voltages generated by D/A converters 38 and 46 onto output terminals 20 and 24, respectively. Once again, each output terminal has a polarity that is the opposite of its neighboring output terminals.

Thus, first multiplexer 25 and second multiplexer 26 collectively form analog multiplexer circuitry adapted to transmit, during the first column driving cycle, the first analog voltage signal to the first column output terminal and the second analog voltage signal to the second column output terminal; during the second column driving cycle, the analog multiplexer circuitry collectively formed by multiplexers 25 and 26 transmits the first analog voltage signal to the second column output terminal and transmits the second analog voltage signal to the first column output terminal. In this manner, each pair of output terminals (such as OUT 1 and OUT 2) requires only a single high-level D/A converter (28) and a single low-level D/A converter (30) in order to provide two full-range output signals (OUT 1 and OUT 2).

It will be noted that each output pair includes an even-numbered output terminal (such as OUT 2) and an odd-numbered output terminal (such as OUT 1). In order to ensure that the circuitry described above operates properly, it is necessary to provide the high-level D/A converter (28) with the odd-numbered output terminal (OUT 1) information when polarity control signal 31 is low, and to provide the high-level D/A converter (28) of each pair with the even-numbered output terminal (OUT 2) information when polarity control signal 31 is high. Likewise, it is necessary to provide the low-level D/A converter (30) within each pair with the even-numbered output terminal (OUT 2) information when polarity control signal 31 is at a low level, and to provide the low-level D/A converter (30) with the odd-numbered output terminal (OUT 1) information when polarity control signal 32 is high.

Within FIG. 1, each D/A converter 28, 30, 38, 40, 46 and 48 includes a plurality of input terminals (represented within FIG. 1 as a single input line for convenience) for receiving a digital data word in the form of a seven-bit digital signal from a corresponding data latch. For example, high-level D/A converter circuit 28 receives a seven-bit digital input signal from data latch 50 via conductors 51. Likewise, low level D/A converter circuit 30 receives a seven-bit digital input signal from data latch 52 via conductors 53. In a similar manner, high-level D/A converter 38 and low level D/A converter 40 are coupled to the output of data latches 54 and 56, respectively, and high-level D/A converter 46 and low-level D/A converter 48 are coupled to the output of data latches 58 and 60.

Data latch 50 latches a seven-bit digital word at periodic intervals in order to capture a digital signal which corresponds to the analog voltage to be generated by high-level D/A converter 28. Likewise, data latches 52–60 capture, at periodic intervals, the seven-bit-wide digital signals that correspond to the magnitudes of the analog voltages to be generated by D/A converters 30–48, respectively. Each of data latches 50–60 includes an enable (En) input terminal coupled to Load conductor 62 for receiving a Load signal. Referring briefly to FIG. 2, a timing waveform for the Load signal 64 is shown as including a positive pulse at the beginning of each row drive period. Thus, pulse 66 represents the beginning of a first row drive period, while pulse 68 coincides with the beginning of a second, next-succeeding row drive period. The application of the positive pulse of Load signal 62 to each enable input of data latches 50–60 causes the seven-bit-wide digital signal provided to the data input terminals of each such data latch to be temporarily stored therein, and available at the Q output terminals thereof, until the next positive Load pulse is received. Once again, FIG. 2 illustrates timing for the case of pixel inversion; hence, polarity control signal 31 changes state at the start of each row drive period.

For reasons that will become more apparent as this description proceeds, the data latched by data latches 50–60 is provided by a further set of preceding data latches 70, 72, 74, 76, 78, and 80. Like data latches 50–60, each of data latches 70–80 includes an enable (En) input terminal for receiving a pulsed enabling signal for entering new data into each data latch. However, as is indicated in FIG. 1, data latches 70–80 are not enabled concurrently, as by a single Load signal; rather, data latches 70–80 are enabled in groups of 3. Thus, the first three data latches 70, 72, and 74 are enabled as a first group, while a second group of three data latches 76, 78, and 80 are enabled as a group at a slightly later point in time.

Each of data latches 70, 72, and 74 includes an enable (En) input terminal coupled to an Enable conductor 82 for receiving an Enable control signal 84 (see FIG. 2). A first positive pulse 86 is generated on Enable signal 84 during a first row drive period, and a second positive pulse 88 is generated during the second row drive period. The seven-bit-wide data input terminals of data latch 70 are coupled to a first intermediate data bus 90 (I1). The seven-bit-wide data input terminals of data latch 72 are coupled to a second intermediate data bus 92 (I2). Similarly, the seven-bit-wide data input terminals of data latch 74 are coupled to a third intermediate data bus 94 (I3). Intermediate data buses I1, I2, and I3 function to provide three seven-bit datawords at a time for updating three data latches at a time.

Data buses 90, 92, and 94 are also coupled to the data input terminals of data latches 76, 78, and 80, respectively, as well as to each further triplet of data latches. However, the second group of data latches 76, 78, and 80 is enabled by enabling control signal (E1) 104 (see FIG. 2) as provided on conductor 96. As indicated in FIG. 1, a clock conductor 98 is routed to several blocks of the circuitry shown in FIG. 1, including shift register block 100, for providing clock signal 102 thereto. The data input terminal of shift register 100 is coupled to the Enable conductor 82 for receiving the Enable signal therefrom. The output terminal Q of shift register 100 generates enabling signal (El) 104 on conductor 96. It will be appreciated that the enabling signal E1 104 includes a first positive pulse 106 and second positive pulse 108; pulse 106 is delayed by one clock cycle relative to pulse 86 of Enable signal 84, and second pulse 108 is delayed by one clock cycle relative to the second pulse 88 of the Enable control signal 84.

Thus, during a first clock cycle, data latches 70, 72 and 74 are enabled by Enable signal 84 and latch the data on intermediate data buses 90 (I1), 92 (I2), and 94 (I3). During the next clock cycle, data latches 76, 78 and 80 are enabled by El signal 104 and latch the data on intermediate data buses 90 (I1), 92 (I2), and 94 (I3). During the next clock cycle, a next group of three data latches (not shown), and corresponding to column output terminals 7, 8, and 9, is enabled by E2 signal 110 (see FIG. 2) and latch the data on intermediate data buses 90 (I1), 92 (I2), and 94 (I3). As indicated in FIG. 1, the E2 enabling signal 110 is provided by conductor 113 at the Q output terminal of a further shift register 112 that receives the prior E1 enabling signal 104 at its data input terminal. This pattern of propagating the enabling signal down the line, and enabling groups of three data latches at a time, is repeated for as many triplets of data latches as are provided within the integrated circuit column driver.

Referring again to FIG. 2, during the first row drive period, each group of three data latches 70–74, 76–80, etc., is consecutively updated with the data that will be needed by the digital-to-analog converters during the next row drive period. After each of such grouped data latches has been updated, the next row drive cycle begins, and Load signal 64 is pulsed to simultaneously enable data latches 50–60 for receiving the data stored by grouped data latches 70–74, 76–80, etc.

As mentioned above, the ability for pairs of column output terminals to share a pair of upper voltage level and lower voltage level D/A converters requires that the correct digital information be presented to each high level D/A converter and each low level D/A converter at the correct time. For example, the digital information required for output terminal 16 (OUT 2) is sometimes provided to D/A converter 28, and is other times provided to D/A converter 30. Thus, in some instances, the data for column output terminal 16 must be present on intermediate data bus 90 (I1), while at other times, the data for output terminal 16 must be present on intermediate data bus 92 (I2). An input digital multiplexing scheme is therefore required in order to insure that the required digital information is presented on the correct data bus at the right time. To better understand the manner by which this problem is resolved, it is helpful to first understand the process by which red, green and blue color pixel data is ordinarily presented to the column driver integrated circuit. This will in turn explain why the present integrated circuit column driver includes an input multiplexer, including data latches 114 and 116, together with Swap Control Muxes block 118, that is adapted to swap the various red, green and blue data words, depending on the state of the polarity signal.

Referring first to FIG. 1, the video control circuitry (not shown) that determines what colors are to be displayed at each point in the LCD display provides seven-bit-wide red, green, and blue datawords on conductors 120, 122, and 124, one at a time for each red, green, and blue pixel lying within the selected row of the LCD display. Conductors 120 bring on-board the seven-bit "red" (R) data word corresponding to the magnitude of a red pixel voltage for a selected point on the LCD display. Similarly, conductors 122 and 124 bring on-board two seven-bit "green" (G) and "blue" (B) data words corresponding to the magnitudes of the green and blue pixel voltages for the same selected point on the LCD display. As shown in FIG. 1, these data words are presented to the input terminals of input data latch 114, and are clocked into data latch 114 by Clock signal 102 provided by conductor 98. FIG. 2 shows the R (red), G (green), and B (blue) data input waveforms as presented to the input terminals of input data latch block 114 by conductors 120, 122 and 124. During a first clock period 126/126', the R, G and B data words provide the data for the first, second and third columns of the LCD array; during a second clock period 128/128' of each row drive period, the R, G and B conductors 120, 122, and 124 provide the data for the fourth, fifth and sixth columns of the LCD array; during a third clock period 130/130', the R, G and B conductors provide the data for the seventh, eighth and ninth columns of the LCD array; and during a fourth clock period 132/132', the R, G and B conductors provide the data for the tenth, eleventh and twelfth columns of the LCD array. This is true both during the first row drive period, when polarity control signal 31 is low, as well as during the second row drive period, when polarity control signal 31 is high.

The Swap Control Muxes block 118 receives the latched output data of data latch block 114. When polarity control signal 31 is low, as is true for the first row drive period shown in FIG. 2, the Swap Control Muxes block 118 does not alter the normal path of the red, green and blue data signals passing therethrough. Thus, the seven bit "red" data word provided by conductors 134, derived from the "red" output terminals of data latch 114, is passed unimpeded through Swap Control Muxes block 118 onto conductors 136 for presentation to the "red" input terminals of data latch block 116; on the next pulse of the Clock signal 102 provided on conductor 98, this "red" data word is latched into data latch 116 and provided onto intermediate data bus 90 (I1). Likewise, the seven bit "green" data word provided by conductors 138, derived from the "green" output terminals of data latch 114, is passed unimpeded through Swap Control Muxes block 118 onto conductors 140 for presentation to the "green" input terminals of data latch block 116; on the next pulse of the Clock signal 102, this "green" data word is latched into data latch 116 and provided onto intermediate data bus 92 (I2). Finally, the seven bit "blue" data word provided by conductors 142, derived from the "blue" output terminals of data latch 114, is passed unimpeded through Swap Control Muxes block 118 onto conductors 144 for presentation to the "blue" input terminals of data latch block 116; on the next pulse of the Clock signal 102, this "blue" data word is latched into data latch 116 and provided onto intermediate data bus 94 (I3).

The waveforms for the intermediate data buses I1, I2 and I3 are also shown in FIG. 2. During the first row drive period, when polarity control signal 31 is low, the data presented on the intermediate data buses I1, I2 and I3 is identical to that presented on the R, G, and B conductors 120, 122 and 124, respectively, except that the data on the intermediate data buses I1, I2, and I3 is delayed by exactly two clock periods. Thus, the data on the R, G and B conductors during clock period 126 is identical to the data presented on the intermediate data buses I1, I2 and I3 during clock period 130. The two clock period delay is introduced by data latch block 114 and data latch block 116.

However, during the second row drive period, when polarity control signal 31 is high, the intermediate data buses I1, I2 and I3 no longer track the R, G, and B conductors in the manner just described above. For example, during clock period 130', intermediate bus I1 carries a "green" data word for OUT 2, intermediate bus I2 carries a "red" data word for OUT 1, and intermediate bus I3 carries a "red" data word for OUT 4. Similarly, during the next clock period 132', intermediate bus I1 carries a "blue" data word for OUT 3, intermediate bus I2 carries a "blue" data word for OUT 6, and intermediate bus I3 carries a "green" data word for OUT 5. This changed manner of operation, as compared with the operation described above for the first row drive period, is achieved by the Swap Control Muxes block 118 of FIG. 1 in a manner that will now be described.

During clock period 128', Swap Control Muxes block 118 receives the "red" data word for OUT 1 on conductors 134 and receives the "green" data word for OUT 2 on conductors 138. However, the high level of polarity control signal 31 causes Swap Control Muxes block 118 to re-direct the "green" data word on conductors 138 to conductors 136, and to re-direct the "red" data word on conductors 134 to conductors 140. The result, as indicated in FIG. 2, is that the "red" data word for OUT 1 is thereafter routed onto intermediate bus 92 (I2), and the "green" data word for OUT 2 is thereafter routed onto intermediate bus 90 (I1).

The "blue" data word for OUT 3 presents a special case. As indicated in FIG. 2, the "blue" data word for OUT 3 is not driven onto any of the intermediate buses I1, I2, or I3 until clock period 132', when it is driven onto intermediate bus I1. The Swap Control Muxes block 118 receives this "blue" data word for OUT 3 via conductors 142 at the same time that it receives the "red" data word for OUT 1 on conductors 134, and at the same time that it receives the "green" data word for OUT 2 on conductors 138 (i.e., during clock period 128'). However, rather than routing the "blue" data word for OUT 3 to data latch 116, the Swap Control Muxes block 118 temporarily stores this data and delays it for an extra clock period; it is for this reason that the Clock signal conductor 98 is an input to Swap Control Muxes block 118. Rather than directing the "blue" data word for OUT 3 to data latch 116, the Swap Control Muxes block 118 selects the non-delayed (i.e., not yet latched) digital signal present on conductors **120/120*a*, corresponding to the "red" data word for OUT 4, onto conductors 144; as a result, as the next clock pulse occurs (at the start of clock period 130'), data latch block 116 latches the digital information for OUT 4 at the same time that it latches the digital information for OUT 1 and OUT 2, thereby placing the "red" data word for OUT 4 onto the intermediate bus I3 at the same time that the "green" data word for OUT 2 is placed on I1, and at the same time that the "red" data word for OUT 1 is placed on I2**.

As shown in FIG. 2, during clock cycle 132', intermediate bus I1 carries the "blue" data word for OUT 3, intermediate bus I2 carries the "blue" data word for OUT 6, and intermediate bus I3 carries the "green" data word for OUT 5. To understand how this happens, one must understand the operation of Swap Control Muxes block 118 during prior clock cycle 130'. During clock period 130', Swap Control Muxes block 118 receives the "red" data word for OUT 4 on conductors 134, but simply ignores such data word. Swap Control Muxes block 118 also receives the "green" data word for OUT 5 on conductors 138 and receives the "blue" data word for OUT 6 on conductors 142, but re-directs the "green" data word for OUT 5 (on conductors 138) to conductors 144, and re-directs the "blue" data word for OUT 6 (on conductors 142) to conductors 140. Accordingly, following receipt of the next clock pulse, as indicated in FIG. 2 during clock pulse 132', the "green" data word for OUT 5 is now routed onto intermediate bus 94 (I3), and the "blue" data word for OUT 6 is now routed onto intermediate bus 92 (I2).

The "blue" data word for OUT 3 again presents a special case. As indicated in FIG. 2, the "blue" data word for OUT 3 is driven onto intermediate bus I1 during clock period 132'. It will be recalled that the Swap Control Muxes block 118 received the "blue" data word for OUT 3 during clock period 128', but internally delayed the "blue" data word for OUT 3 for one clock cycle. During clock cycle period 130', Swap Control Muxes block 118 retrieves the time-delayed "blue" data word for OUT 3 and selects it onto conductors 136 to data latch 116. As a result, as the next clock pulse occurs, and clock period 132' begins, data latch block 116 latches the digital information for OUT 3 on conductors 136 at the same time that it latches the digital information for OUT 6 and OUT 5 on conductors 140 and 144, respectively. The "blue" data word for OUT 3 is therefore provided to intermediate bus I1 at the same time that the "blue" data word for OUT 6 is placed on I2, and at the same time that the "green" data word for OUT 5 is placed on I3.

All of the building blocks shown in FIG. 1 are common circuits, and those skilled in the art are well aware of CMOS transistor implementations of such building blocks using CMOS integrated circuit technology.

Those skilled in the art will appreciate that the apparatus described in FIG. 1, in conjunction with the timing diagrams of FIG. 2, also provides a method of sharing upper voltage level, and lower voltage level, digital-to-analog converters in a column-driver integrated circuit for driving output voltages upon the columns of an LCD display. In practicing such method, one provides a first digital-to-analog converter circuit, such as 28, for producing analog output voltages within the upper voltage range (e.g., +5 volts to +10 volts), as well as a second digital-to-analog converter circuit, such as 30, for producing analog output voltages within the lower voltage range (e.g., 0 to +5 volts). Successive display drive cycles are defined, as by polarity control signal 31, including a first display drive cycle (e.g., the first row drive period shown in FIG. 2) and a second display drive cycle (e.g., the second row drive period shown in FIG. 2).

This method further includes the step of providing a first digital data word (e.g., the data word on conductors 51 during clock period 130) to the first digital-to-analog converter circuit (28) during the first display drive cycle corresponding to the magnitude of a voltage within the upper voltage range to be driven onto a first column of the LCD display (OUT 1). Similarly, a second digital data word (e.g., the data word on conductors 53 during clock period 130) is provided to the second digital-to-analog converter circuit during the first display drive cycle corresponding to the magnitude of a voltage within the lower voltage range to be driven onto a second column of the LCD display (OUT 2). The analog output voltage of the first digital-to-analog converter circuit is selected to the first column (OUT 1) of the LCD display during the first display drive cycle (e.g., during clock period 130), and the analog output voltage of the second digital-to-analog converter circuit is selected to the second column of the LCD display (OUT 2) during the first display drive cycle (e.g., during clock period 130).

During a second display drive cycle (e.g., during clock period 130'), the method includes the steps of providing a first digital data word (e.g., the data word on conductors 51) to the first digital-to-analog converter circuit (28) corresponding to a voltage within the upper voltage range to be driven onto the second column of the LCD display (OUT 2), and providing a second digital data word (e.g., the data word on conductors 53) to the second digital-to-analog converter circuit (30) corresponding to a voltage within the lower voltage range to be driven onto the first column (OUT 1) of the LCD display. The analog output voltage of the second digital-to-analog converter circuit (30) is selected to the first column (OUT 1) of the LCD display during the second display drive cycle (i.e., clock period 130') and the analog output voltage of the first digital-to-analog converter circuit (28) is selected to the second column (OUT 2) of the LCD display during the second display drive cycle (i.e., clock period 130').

Those skilled in the art will now appreciate that an apparatus and method have been described for configuring an integrated circuit column driver to allow paired output terminals to share upper level and lower level digital-to-analog converter circuits, thereby minimizing the number of separate digital-to-analog converter circuits that are required, while allowing each such digital-to-analog converter circuit to be formed of small geometry devices, since each such circuit need only generate an output analog signal that ranges through only one-half of the full analog output voltage range; the result is a column driver integrated circuit of reduced complexity for achieving higher yields at lower costs. The described integrated circuit column driver, and related method, use the Direct Drive method of applying pixel voltages to an LCD display for obtaining improvements in both image quality and power dissipation. Moreover, the described integrated circuit column driver, and related method, are compatible with either of the above-described column inversion and pixel inversion driving methods in order to limit power dissipation and improve the image quality of the display by reducing flicker and crosstalk.

While the present invention has been described with respect to a preferred embodiment thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A column-driver integrated circuit for generating output voltages to be applied to the columns of an LCD display, such output voltages falling within either an upper voltage range or a lower voltage range, said column-driver integrated circuit comprising in combination:

a. a first digital-to-analog converter circuit having a plurality of input terminals for receiving a first digital data word corresponding to a voltage within the upper voltage range, said first digital-to-analog converter circuit including a first analog voltage terminal for providing a first analog voltage signal within the upper voltage range;

b. a second digital-to-analog converter circuit having a plurality of input terminals for receiving a second digital data word corresponding to a voltage within the lower voltage range, said second digital-to-analog converter circuit including a second analog voltage terminal for providing a second analog voltage signal within the lower voltage range;

c. a first column output terminal for providing an analog output voltage to drive a first column within the LCD display;

d. a second column output terminal for providing an analog output voltage to drive a second column within the LCD display; and e. analog multiplexer circuitry coupled to said first and second analog voltage terminals for receiving the first and second analog voltage signals, said analog multiplexer circuitry also being coupled to said first and second column output terminals, said analog multiplexer circuitry transmitting, during a first column driving cycle, the first analog voltage signal to said first column output terminal and the second analog voltage signal to said second column output terminal, and said analog multiplexer circuitry transmitting, during a second column driving cycle, the first analog voltage signal to said second column output terminal and the second analog voltage signal to said first column output terminal.

2. The column-driver integrated circuit recited by claim 1 further including:

a. a polarity control conductor for conducting a polarity control signal, the polarity control signal having a first state during the first column driving cycle and having a second state during the second column driving cycle;

b. said analog multiplexer circuitry being coupled to said polarity control conductor and being responsive to the polarity control signal wherein:

i. said analog multiplexer circuitry provides the first analog voltage signal within the upper voltage range to the first column output terminal, and provides the second analog voltage signal within the lower voltage range to the second column output terminal, when said polarity control signal is in its first state; and ii. said analog multiplexer circuitry provides the first analog voltage signal within the upper voltage range to the second column output terminal, and provides the second analog voltage signal within the lower voltage range to the first column output terminal, when said polarity control signal is in its second state.

3. The column-driver integrated circuit recited by claim 2 wherein said analog multiplexer circuitry includes a first multiplexer, said first multiplexer receiving the first and second analog voltage signals and transmitting the first analog voltage signal to said first column output terminal when the polarity control signal is in its first state, and transmitting the second analog voltage signal to said first column output terminal when the polarity control signal is in its second state.

4. The column-driver integrated circuit recited by claim 3 wherein said analog multiplexer circuitry includes a second multiplexer, said second multiplexer receiving the first and second analog voltage signals and transmitting the second analog voltage signal to said second column output terminal during when the polarity control signal is in its first state, and transmitting the first analog voltage signal to said second column output terminal when the polarity control signal is in its second state.

5. The column-driver integrated circuit recited by claim 2 further including:

a. a first data latch coupled to said plurality of input terminals of said first digital-to-analog converter circuit, said first data latch temporarily storing a current first digital data word during each column driving cycle, and providing the temporarily stored current first digital data word to said plurality of input terminals of said first digital-to-analog converter circuit; and b. a second data latch coupled to said plurality of input terminals of said second digital-to-analog converter circuit, said second data latch temporarily storing a current second digital data word during each column driving cycle, and providing the temporarily stored current second digital data word to said plurality of input terminals of said second digital-to-analog converter circuit.

6. The column-driver integrated circuit recited by claim 2 further including a digital input multiplexer circuit having input terminals for receiving a first multi-bit digital signal representing the magnitude of the analog voltage to be provided at said first column output terminal and for receiving a second multi-bit digital signal representing the magnitude of the analog voltage to be provided at said second column output terminal, said digital input multiplexer circuit also being coupled to said polarity control conductor for receiving the polarity control signal, said digital input multiplexer circuit being responsive to the polarity control signal for:

a. providing the first multi-bit digital signal to the plurality of input terminals of the first digital-to-analog converter circuit as the first digital data word thereof, and providing the second multi-bit digital signal to the plurality of input terminals of the second digital-to-analog converter circuit as the second digital data word thereof, when the polarity control signal is in its first state; and b. providing the first multi-bit digital signal to the plurality of input terminals of the second digital-to-analog converter circuit as the second digital data word thereof, and providing the second multi-bit digital signal to the plurality of input terminals of the first digital-to-analog converter circuit as the first digital data word thereof, when the polarity control signal is in its second state.

7. The column-driver integrated circuit recited by claim 6 wherein said digital input multiplexer circuit includes at least a first plurality of digital input terminals for receiving the first multi-bit signal and a second plurality of digital input terminals for receiving the second multi-bit signal, said digital input multiplexer circuit also including a first output bus coupled to the plurality of input terminals of said first digital-to-analog converter circuit and a second output bus coupled to the plurality of input terminals of said second digital-to-analog converter circuit.

8. A method of sharing digital-to-analog converters in a column-driver integrated circuit used to drive output voltages upon the columns of an LCD display, such output voltages falling within either an upper voltage range or a lower voltage range, said method comprising the steps of:

a. providing a first digital-to-analog converter circuit for producing analog output voltages within the upper voltage range;

b. providing a second digital-to-analog converter circuit for producing analog output voltages within the lower voltage range;

c. defining successive display drive cycles, including a first and second display drive cycle;

d. providing a first digital data word to the first digital-to-analog converter circuit during the first display drive cycle corresponding to a voltage within the upper voltage range to be driven onto a first column of the LCD display;

e. providing a second digital data word to the second digital-to-analog converter circuit during the first display drive cycle corresponding to a voltage within the lower voltage range to be driven onto a second column of the LCD display;

f. selecting the analog output voltage of the first digital-to-analog converter circuit for transmission to the first column of the LCD display during the first display drive cycle;

g. selecting the analog output voltage of the second digital-to-analog converter circuit for transmission to the second column of the LCD display during the first display drive cycle;

h. providing a first digital data word to the first digital-to-analog converter circuit during the second display drive cycle corresponding to a voltage within the upper voltage range to be driven onto the second column of the LCD display;

i. providing a second digital data word to the second digital-to-analog converter circuit during the second display drive cycle corresponding to a voltage within the lower voltage range to be driven onto the first column of the LCD display;

j. selecting the analog output voltage of the second digital-to-analog converter circuit for transmission to the first column of the LCD display during the second display drive cycle; and k. selecting the analog output voltage of the first digital-to-analog converter circuit for transmission to the second column of the LCD display during the second display drive cycle.

* * * * *